US007444091B2

(12) United States Patent
Matayoshi et al.

(10) Patent No.: US 7,444,091 B2
(45) Date of Patent: Oct. 28, 2008

(54) IMAGE FORMING APPARATUS HAVING A TONER CARRYING MEMBER

(75) Inventors: Akira Matayoshi, Osaka (JP); Mitsuhiro Hashimoto, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 267 days.

(21) Appl. No.: 11/335,483

(22) Filed: Jan. 20, 2006

(65) Prior Publication Data

US 2006/0165425 A1 Jul. 27, 2006

(30) Foreign Application Priority Data

Jan. 21, 2005 (JP) ..... 2005-014285

(51) Int. Cl.
*G03G 15/00* (2006.01)

(52) U.S. Cl. ..... 399/49

(58) Field of Classification Search ..... 399/49
See application file for complete search history.

(56) References Cited

FOREIGN PATENT DOCUMENTS

| | | |
|---|---|---|
| JP | 06-250480 | 9/1994 |
| JP | 2001-194843 | 7/2001 |
| JP | 2002-023433 | 1/2002 |
| JP | 2004-177608 | 6/2004 |

OTHER PUBLICATIONS

Electronic Translation of JP 2004-177608.*

* cited by examiner

*Primary Examiner*—David M. Gray
*Assistant Examiner*—Ryan D Walsh
(74) *Attorney, Agent, or Firm*—Smith, Gambrell & Russell, LLP

(57) ABSTRACT

The difference between the light reception output signals representing the amounts of regularly and irregularly reflected light as measured, with optical detecting means that can measure the amount of regularly and irregularly reflected light simultaneously, when no toner is adhered to a transfer belt is set as a reference value, a corrected output value is calculated by correcting, based on the reference value, the difference between the light reception output signals representing the amounts of regularly and irregularly reflected light as measured when a toner image is formed, and the amount of toner adhered to the transfer belt is calculated based on the corrected output value. With transfer belts of different colors, if their surface gloss is equal to or lower than a predetermined value, the relationship between the coverage ratio and the toner adhesion amount remains approximately identical. Thus, when a transfer belt whose initial surface gloss is equal to or lower than 20 at a measurement angle of 60 degrees, the amount of toner adhered can be measured precisely until the expiration of the warranted use period of the belt.

10 Claims, 6 Drawing Sheets

--PRIOR ART--

--PRIOR ART--

--PRIOR ART--

IMAGE FORMING APPARATUS HAVING A TONER CARRYING MEMBER

This application is based on Japanese Patent Application No. 2005-014285 filed on Jan. 21, 2005, the contents of which are hereby incorporated by reference.

BACKGROUND OF THE INVENTION

1. Field of the Invention

The present invention relates to an image forming apparatus relying on electrophotography, and more particularly to how to measure the amount of toner adhered to a toner carrying member that carries it.

2. Description of Related Art

In an image forming apparatus employing an electrophotographic process, density correction and color-shift correction are generally achieved by transferring toner directly onto a toner carrying member to form a patch image (reference image) thereon and then detecting the amount of toner with which and the position at which the patch image is formed. For example, in a tandem-type full-color image forming apparatus, patch images of different colors are formed on a transfer belt by a cyan, a magenta, a yellow, and a black image forming section, and the thus formed patch images are then detected by detecting means for the purposes of density correction and color-shift correction.

Generally used as the detecting means is optical detecting means realized with a combination of a light—emitting device such as an LED and a light—receiving device such as a photodiode. For example, to measure the amount of toner adhered to the transfer belt, measurement light is shone from the light-emitting device on a toner image. The measurement light is then reflected partly on the toner and partly on the belt surface so as to be received by the light-receiving device.

When the amount of toner adhered is large, more light is intercepted by the toner, and accordingly less light is reflected on the belt surface; thus the light-receiving element receives less light. By contrast, when the amount of toner adhered is small, more light is reflected on the belt surface, and thus the light-receiving element receives more light. Thus, by monitoring the density of the patch images of the different colors as known from the output level of the light reception signal that is so outputted as to be commensurate with the amount of reflected light received, then comparing it with a prescribed reference density, it is possible to adjust the charge voltage, the development bias voltage, and the amount of light emitted from an LED head and thereby achieve density correction for each color.

To perform precise density correction based on patch images, the amount of toner adhered to the transfer belt needs to be measured precisely. For example. according to Japanese Patent Application Laid-open No. 2002-23433 (hereinafter, patent publication 1), measurement light is shone on a reference patch image formed on a toner carrying member, and the amount of light regularly reflected therefrom is detected to measure the amount of toner adhered. Here, if the toner carrying member has a low-gloss surface, regardless of the patch density, the sensor output is low, making it difficult to perform precise detection of the patch density. For this reason, patent publication 1 recommends the use of a toner carrying member having a specific surface gloss or higher (specifically 50 or more but 98 or less when measured at an angle of 20°).

On the other hand, according to Japanese Patent Application Laid-open No. 2001-194843 (hereinafter, patent publication 2), measurement light is shone on a reference image, and the difference between the amount of light regularly reflected therefrom and the amount of light irregularly reflected therefrom is detected to measure the amount of toner adhered. According to this method, unlike the method disclosed in patent publication 1 according to which only the amount of light regularly reflected is detected, the sensor output varies greatly with the patch density regardless of whether the toner is black or colored, permitting precise detection of the amount of toner adhered in particular in a color image forming apparatus. Even in this case, to obtain a sufficient amount of regularly reflected light, as recommended in patent publication 1, a toner carrying member having a specific surface gloss or higher is used.

Generally, as an image forming apparatus is used for an extended period of time, and also under the influence of ingredients (for example, an abrasive component) of toner other than the toner component, the surface condition of a toner carrying member changes. This makes it impossible to keep the initial surface condition until the expiration of the warranted normal-operation period of the toner carrying member. This change in the surface condition causes the light reception output of the light-receiving device to vary. Thus, according to the methods disclosed in patent publications 1 and 2, it is difficult to precisely measure the amount of toner adhered.

To overcome this, there has been proposed a method for precisely measuring the amount of toner adhered regardless of change in the surface condition of a toner carrying member. Specifically, Japanese Patent Application Laid-open No. 2004-177608 (hereinafter, patent publication 3) discloses an image forming apparatus as shown in FIGS. 5A to 5C that uses a toner adhesion amount measurement apparatus (see Japanese Patent Registered No. 2729976 (hereinafter, patent publication 4)) provided with light emitting means for emitting, at a predetermined angle, uniformly polarized light, a polarization splitting prism for splitting the light reflected from a toner carrying member or from toner into light polarized in the same way as the emitted light and light polarized otherwise, and first and second light receiving means for receiving light polarized in the two different ways, respectively, thus split by the polarization splitting prism. Here, the image forming apparatus is so adjusted that the levels of the reception output signals as obtained from the first and second light-receiving means when a predetermined amount of toner is adhered to the toner carrying member are equal.

The toner adhesion amount measurement apparatus (optical detecting means) 9 shown in FIGS. 5A to 5C includes a light-emitting device (for example, an LED) 20 that shines measurement light on the surface of a transfer belt 8 and a first and a second light-receiving device 21 and 22 that receive the light reflected from the transfer belt 8. Between the light-emitting device 20 and the transfer belt 8, a polarization filter 23 is arranged that transmits only P-polarized light. On the other hand, between the second light-receiving device 22 and the transfer belt 8, a polarization separation prism 24 is arranged that transmits P-polarized light to direct it to the first light-receiving device 21 and that reflects S-polarized light to direct it to the second light-receiving device 22.

Suppose now that a sufficient amount (proper amount) of toner has been transferred onto the transfer belt 8, and measurement light is shone from the light-emitting device 20 on the transfer belt 8. Then, as shown in FIG. 5A, of the P-polarized light (hereinafter referred to as regularly reflected light) P1 and the S-polarized light (hereinafter referred to as irregularly reflected light) S1 contained in the measurement light, the light S1 is intercepted by the polarization filter 23, and thus only the light P1 passes through the polarization filter 23 to reach the transfer belt 8. Since the light P1 is not transmitted through the toner t, it does not reach the surface of the transfer belt 8, but is reflected on the surface of the toner t.

The reflected light is separated by the polarization separation prism 24 into regularly reflected light P3 and irregularly reflected light S3, of which the light P3 is received by the first light-receiving device 21 and the light S3 is received by the second light-receiving device 22. The first and second light-receiving devices 21 and 22 perform photoelectric conversion on the light they have received, and output a first and a second output signal, respectively. The first and second output signals are then subjected to A/D conversion, and are then fed to a control section (unillustrated). The control section adjusts the output levels (gains) of the first and second light-receiving devices in such a way that, when a proper amount of toner is adhered to the transfer belt 8, the levels of the first and second output signals are equal.

By contrast, suppose now that, as shown in FIG. 5B, no toner image has yet been formed on the transfer belt 8, and that measurement light containing regularly reflected light P1 and irregularly reflected light S1 is shone on the transfer belt 8. Then, the light S1 is intercepted by the polarization filter 23, and only the light P1 reaches the surface of the transfer belt 8, on which the light P1 is reflected as reflected light containing varying proportions of regularly and irregularly reflected light according to the surface shape (for example, surface roughness) of the transfer belt 8. The reflected light is then separated by the polarization separation prism 24 into regularly reflected light P2 and irregularly reflected light S2, of which the light P2 is received by the first light-receiving device 21 and the light S2 is received by the second light-receiving device 22.

The first and second light-receiving devices 21 and 22 perform photoelectric conversion on the light (P2 and S2) they have received, and output a first and a second output signal, respectively. The first and second output signals are then subjected to A/D conversion, and are then fed to the control section. The control section sets, as a reference value, the difference between the first and second output signals at the moment. After the adjustment of the output levels of the first and second light-receiving devices and the setting of the reference value as described above, the amount of toner adhered to the transfer belt 8 is measured as shown in FIG. 5C.

In FIG. 5C, as in FIGS. 5A and 5B, of the P-polarized light P1 and the S-polarized light S1 contained in the measurement light, the light S1 is intercepted by the polarization filter 23, and only the light P1 reaches the toner. If the amount of toner with which the toner image formed on the transfer belt 8 is formed is insufficient, part of the light P1 that has struck the toner is reflected on the surface of the toner t, and the rest is transmitted through the toner t. The light that is transmitted through the toner t is then reflected on the surface of the transfer belt 8.

That is, the light P1 that has reached the surface of the transfer belt 8 is reflected partly as regularly reflected light P2 and partly as irregularly reflected light S2. The regularly and irregularly reflected light P2 and S2 is then separated by the polarization separation prism 24, so that the light P2 is received by the first light-receiving device 21 and the light S2 by the second light-receiving device 22. Likewise, the regularly and irregularly reflected light P3 and S3 reflected on the surface of the toner t is separated by the polarization separation prism 24, so that the light P3 is received by the first light-receiving device 21 and the light S3 by the second light-receiving device 22.

As described above, the first and second light-receiving devices 21 and 22 performs photoelectric conversion on the light they have received, and output the first and second output signals, respectively, which are then subjected to A/D conversion, and are then fed to the control section. The control section calculates, as a measured output value, the difference between the first and second output signals, and then, based on the above-mentioned reference value, corrects the measured output value to determine a corrected output value. Thus, if the corrected output value determined when no toner is adhered equals 1, the corrected output value at a given moment is calculated as the measured output value divided by the reference value.

The control section has stored therein, as toner adhesion amount data, the relationship between the measured output value and the amount of toner adhered. Thus, according to the corrected output value, and based on the toner adhesion amount data, the control section can know the amount of toner adhered (image density) and output it as a result of measurement. The toner coverage ratio C is calculated according to formula (1) below.

$$C=1-[(P-P_0)-(S-S_0)]/[(Pg-P_0)-(Ss-S_0)] \quad (1)$$

where

P represents the light reception output voltage corresponding to the amount of light regularly reflected from the reference image;

S represents the light reception output voltage corresponding to the amount of light irregularly reflected from the reference image;

$P_0$ represents the light reception output voltage corresponding to the amount of light regularly reflected when no light is shone;

$S_0$ represents the light reception output voltage corresponding to the amount of light irregularly reflected when no light is shone;

Pg represents the light reception output voltage corresponding to the amount of light regularly reflected from the surface of the toner carrying member; and Sg represents the light reception output voltage corresponding to the amount of light irregularly reflected from the surface of the toner carrying member.

That is, when a proper amount of toner is adhered to the belt, the output levels (gains) of the light-receiving devices are adjusted such that $P-P_0=S-S_0$, and hence the coverage ratio C equals 1. When no toner is adhered to the belt, P=Pg and S=Sg, and hence the coverage ratio C equals 0. In a case where the amount T of toner adhered is 1 mg/cm$^2$ when the coverage ratio C equals 1, the amount T of toner adhered is calculated directly according to formula (1) noted above.

According to the method disclosed in patent publication 3, when a predetermined amount of toner is adhered, the difference between the light reception output signals from the first and second light-receiving devices 21 and 22 remains 0 regardless of the surface condition of the toner carrying member. Thus, the levels of the light reception output signals can be corrected according to the change, as results from secular change, in the surface condition of the transfer belt 8. This permits precise measurement of the amount of toner adhered.

As the surface gloss of the toner carrying member secularly changes, however, the relationship between the coverage ratio C calculated according to formula (1) above and the amount of toner adhered changes. FIG. 6 shows the results of measurement of the coverage ratio and the toner adhesion amount as measured by the method described above with respect to two types of transfer belt A and B having an equal surface gloss (60 at a measurement angle of 60° and 13 at a measurement angle of 20°) plus another transfer belt C, which is the same as the transfer belt A but has undergone an endurance test for a predetermined number of hours to have a lower surface gloss (2 at a measurement angle of 60° and 0 at a measurement angle of 20°). The surface gloss was measured on a gloss checker (the model IG-330) manufactured by HORIFBA Ltd.

The transfer belt A had a brown color expressed as (17, 8, 5) in L*a*b* notation (whereby a given color is defined in a color space assumed along three mutually perpendicular axes, namely the L* axis representing lightness, the a* axis representing red-to-green chromaticity, and the b* axis representing yellow-to-blue chromaticity), or as (59, 41, 38) in RGB notation (whereby a given color is defined in terms of the intensities of light of three, namely R (red), G (green), and B (blue), colors). Likewise, the transfer belt B had a whitish light brown color expressed as (76, 4, 20) in L*a*b* notation, or as (209, 182, 149) in RGB notation, and the transfer belt C had a gray color expressed as (44, 0, −7) in L*a*b* notation, or as (97, 104, 114) in RGB notation.

As will be clear from a comparison between the results with the transfer belt A (indicated by a solid line in the figure) and those with the transfer belt B (indicated by a dotted line in the figure), so long as the surface gloss is equal, two different colors, like brown and whitish light brown in this particular case, exhibit an approximately identical relationship between the coverage ratio and the toner adhesion amount. By contrast, as will be clear from a comparison between the results with the transfer belt B and those with the transfer belt C (indicated by a dash-and-dot line in the figure), if the surface gloss differs greatly, even two similar colors, like whitish light brown and gray in this particular case, exhibit different relationships between the coverage ratio and the toner adhesion amount, except when a proper amount of toner is adhered and hence the coverage ratio equals around 1.

Thus, to keep an identical relationship between the coverage ratio and the toner adhesion amount throughout the whole range, even with the method according to patent publication 3, it is necessary to maintain the gloss of the toner carrying member. As described earlier, however, it is difficult to maintain the initial surface condition until the expiration of the warranted normal-operation period of the toner carrying member. Moreover, when the transfer belt 8 is formed of a hard material, stress concentration between the transfer belt and the photoconductive member causes toner to adhere firmly to the photoconductive member non-electrostatically. As a result, even when a transfer voltage is applied to the transfer belt or the transfer roller, the toner on the surface of the photoconductive member cannot completely be transferred to the transfer belt. This increases the likeliness of density loss in a central portion of a solidly colored area.

Accordingly, it is preferable to use, as the transfer belt 8, an elastic belt formed of a soft material such as rubber with a view to alleviating stress concentration. In general, however, as compared with hard belts, elastic belts are more prone to deterioration in surface condition, and more quickly lose gloss. Moreover, as the materials for soft belts, only limited kinds of materials are satisfactory in performance. Thus, it is extremely difficult to maintain gloss.

SUMMARY OF THE INVENTION

In view of the conventionally encountered inconveniences mentioned above, it is an object of the present invention to provide an image forming apparatus that can produce high-quality images through highly precise control of image density achieved through precise measurement of toner adhesion amount regardless of the lifetime of a toner carrying member.

To achieve the above object, according to the present invention, an image forming apparatus is provided with: optical detecting means for shining light on a reference image formed on a toner carrying member to measure the amount of regularly reflected light and the amount of irregularly reflected light simultaneously; and controlling means for detecting the amount of adhered toner based on the difference between light reception output signals representing the amount of regularly reflected light and the amount of irregularly reflected light measured by the optical detecting means for the purpose of controlling image density. Here, the image forming apparatus is so adjusted that the light reception output signals representing the amount of regularly reflected light and the amount of irregularly reflected light as obtained when a predetermined amount of toner is adhered to the toner carrying member have an equal level. Moreover, the toner carrying member has a surface gloss of 20 or less at a measurement angle of 60 degrees.

With this design, so long as a toner carrying member having a surface gloss of 20 or lower at a measurement angle of 60 degrees is used, even when the surface condition of the toner carrying member changes through continued use or under the influence of an additive contained in the toner, the surface gloss changes less up to the expiration of the warranted use period. This stabilizes the relationship between the coverage ratio and the toner adhesion amount as calculated based on the difference between the amounts of regularly and irregularly reflected light, and thus makes it possible to precisely measure the amount of toner adhered regardless of the surface condition of the toner carrying member.

Moreover, according to the present invention, in the image forming apparatus designed as described above, the controlling means sets, as a reference value, the difference between the light reception output signals representing the amount of regularly reflected light and the amount of irregularly reflected light as measured when no toner is adhered to the toner carrying member, then calculates a corrected output value by correcting, based on the reference value, the difference between the light reception output signals representing the amount of regularly reflected light and the amount of irregularly reflected light as measured when a toner image is formed on the toner carrying member, and then calculates, based on the corrected output value, the amount of toner adhered to the toner carrying member.

With this design, by correcting the levels of the light reception output signals according to the change, as results from secular change, in the surface condition of the toner carrying member, and by using a method for calculating the amount of toner adhered that permits precise measurement of the amount of toner adhered, it is possible to measure more precisely the amount of toner adhered.

Moreover, according to the present invention, the toner carrying member is a transfer belt for conveying a recording medium.

With this design, by using as the toner carrying member a transfer belt for transferring a recording medium, in a case where density correction is achieved by forming a patch image on the transfer belt, it is possible to perform precise correction and thereby form higher-quality images.

Moreover, according to the present invention, the toner carrying member is an intermediary transfer belt on which toner images to be transferred to a recording medium are laid one on top of another.

With this design, by using as the toner carrying member an intermediary transfer belt on which toner images to be transferred to a recording medium are laid one on top of another, in a case where density correction is achieved by forming a patch image on the intermediary transfer belt, it is possible to perform precise correction and thereby form higher-quality images.

Moreover, according to the present invention, the transfer belt or the intermediary transfer belt is an elastic belt.

With this design, by using as the transfer belt or the intermediary transfer belt an elastic belt, it is possible to precisely measure the amount of toner adhered, and it is also possible to prevent toner from adhering firmly to the photoconductive drum under stress concentration and thereby prevent density loss in a central portion of a solidly colored area.

DETAILED DESCRIPTION OF PREFERRED EMBODIMENTS

Figure 1:
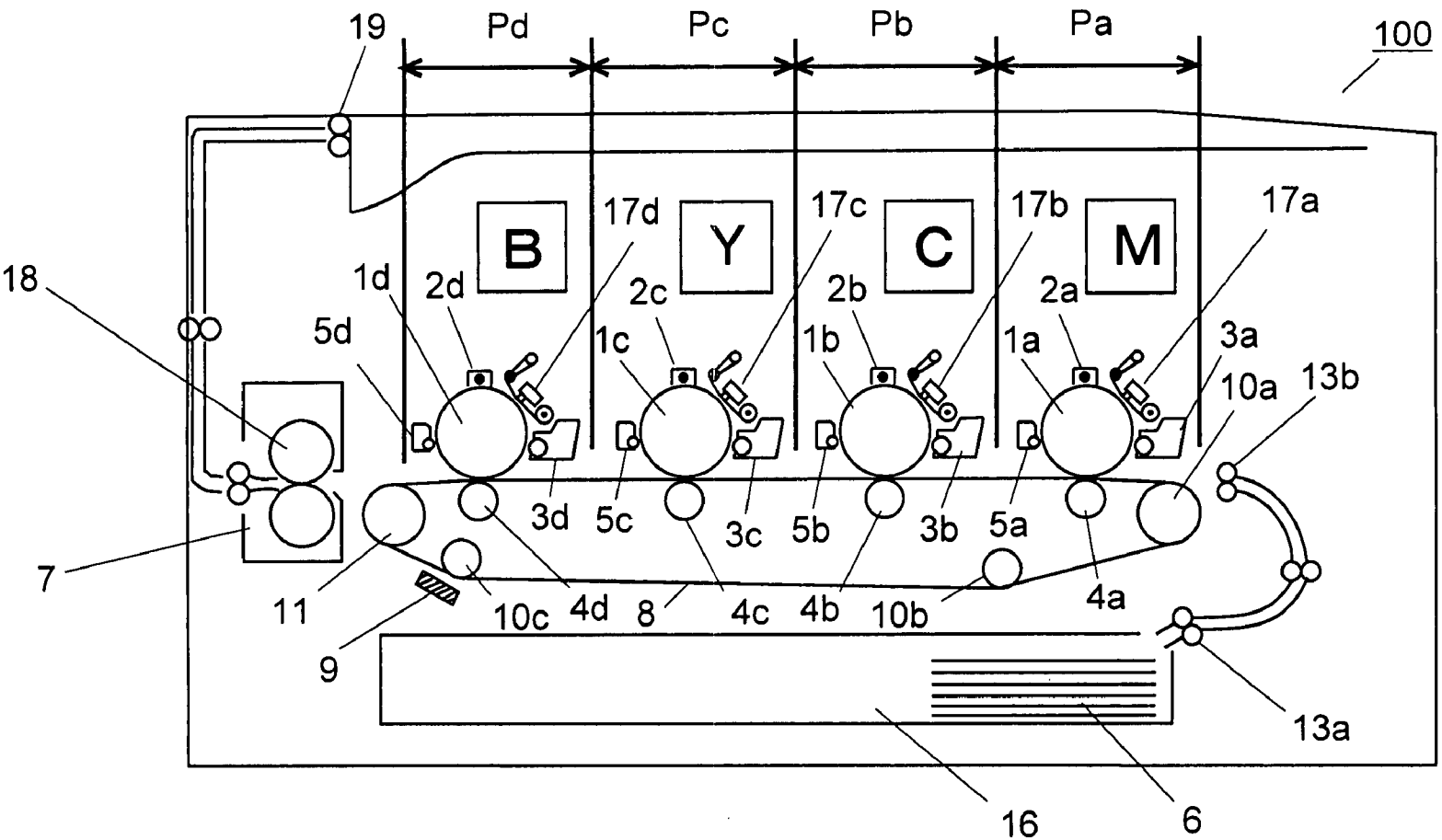
FIG. 1 is a diagram schematically showing the overall construction of an image forming apparatus according to the present invention.

Hereinafter, with reference to the drawings, an embodiment of the present invention will be described in detail. FIG. 1 is a diagram schematically showing an image forming apparatus according to the present invention. Here, a tandem-type color image forming apparatus will be dealt with. Inside the body of the image forming apparatus 100, four image forming sections Pa, Pb, Pc, and Pd are arranged in this order from the upstream side (the right side in FIG. 1) of a transfer belt 8. These image forming sections Pa, Pb, Pc, and Pd are for forming images of four different colors (magenta, cyan, yellow, and black), and form a magenta, a cyan, a yellow, and a black image sequentially, each through an image forming process involving charging, exposure, development, and transfer.

In the image forming sections Pa, Pb, Pc, and Pd, photoconductive drums 1*a*, 1*b*, 1*c*, and 1*d* are arranged that carry visible images (toner images) of the different colors. The toner images formed on the photoconductive drums 1*a* to 1*d* are transferred onto transfer paper 6 that is carried and conveyed by the transfer belt 8 passing by the side of the image forming sections. The toner images are then fixed on the transfer paper 6 by a fixing section 7, and the transfer paper 6 is then ejected out of the body of the image forming apparatus 100. While the photoconductive drums 1*a* to 1*d* are rotated clockwise as seen in FIG. 1, the image forming process is performed for each of them.

Next, the image forming sections Pa to Pd will be described. Around and above the photoconductive drums 1*a* to 1*d*, which are rotatably arranged, the following components are arranged: charger units 2*a* to 2*d* for electrically charging the photoconductive drums 1*a* to 1*d*; LED heads 17*a* to 17*d* for exposing the photoconductive drums 1*a* to 1*d* to light according to image data; developer units 3*a* to 3*d* for forming toner images on the photoconductive drums 1*a* to 1*d*; and cleaner units 5*a* to 5*d* for removing the developer (toner) remaining on the photoconductive druns 1*a* to 1*d*.

First, the charger units 2*a* to 2*d* electrically charges the surface of the photoconductive drums 1*a* to 1*d* uniformly. Next, the LED heads 17*a* to 17*d* shine light on the photoconductive drums 1*a* to 1*d* to form thereon electrostatic latent images according to image signals. The developer units 3*a* to 3*d* are loaded, by toner feeding apparatuses (unillustrated), with predetermined amounts of magenta, cyan, yellow, and black toners, respectively. The developer units 3*a* to 3*d* feed the toners onto the photoconductive drums 1*a* to 1*d*, and the toners electrostatically adheres thereto. Thus, toner images are formed according to the electrostatic latent images formed through exposure to the light from the LED heads 17*a* to 17*d*.

The transfer paper 6, on which the toner images are to be transferred, is stocked in a paper cassette 16 arranged in a lower portion of the image forming apparatus 100, is fed via paper feed rollers 13*a* and resist rollers 13*b* onto the transfer belt 8, and is then conveyed to the photoconductive drums 1*a* to 1*d* one after the next. Used as the transfer belt 8 is a belt formed by putting and joining together the ends of a strip into an endless shape, or a seamless belt. From the perspective of its material, used as the transfer belt 8 is a resin belt, preferably a multiple-layer rubber belt having a fluororesin coat, a silicone coat, a CR rubber sheet, and a PVDF resin sheet laid in this order from the top.

The transfer belt 8 is wound, on the upstream side, around a driven roller 10*a* and, on the downstream side, around a drive roller 11. When the transfer belt 8 starts rotating counter-clockwise, the transfer paper 6 is conveyed via the resist rollers 13*b* and then via an attraction roller (unillustrated) provided at the upstream-side end of the transfer belt 8 onto the transfer belt 8. The attraction roller has a predetermined voltage applied thereto, so that the attraction roller, with the electrostatic attraction it exerts, keeps the transfer paper 6 on the transfer belt 8.

Now, an image write start signal turns on, and an image is formed on the most upstream photoconductive drum 1*a*. Then, in the electric field produced by a transfer roller 4*a* provided below the photoconductive drum 1*a* and having a predetermined transfer voltage applied thereto, a magenta toner image on the photoconductive drum 1*a* is transferred onto the transfer paper 6. The transfer paper 6 is then conveyed to the next image forming section Pb, where, in the same manner as described just above, the photoconductive drum 1*b* transfers a cyan toner image.

Subsequently, in the same manner as described above, the photoconductive drums 1*c* and 1*d* transfer a yellow and a black toner image, respectively. These four-color images are formed with a predetermined positional relationship among them on the transfer paper 6 so as to form a predetermined full-color image. Transfer rollers 4*b*, 4*c*, and 4*d* are arranged below the photoconductive drums 1*b* to 1*d*. The transfer paper 6, having the four-color toner images transferred thereon, then leaves the transfer belt 8 and is conveyed to the fixing section 7. After the transfer of the toner images, the cleaner units 5*a* to 5*d* clean the photoconductive drums 1*a* to 1*d* to remove the toners remaining on the surface thereof in preparation for the formation of new electrostatic latent images.

The transfer paper 6 conveyed from the transfer belt 8 to the fixing section 7 is then heated and pressed by a fixing roller 18, so that the toner images are fixed on the surface of the transfer paper 6 to form the predetermined full-color image.

Having the full-color image formed thereon, the transfer paper 6 is then ejected out of the image forming apparatus 100 by ejection rollers 19.

In image formation performed in a tandem-type color image forming apparatus like the one shown in FIG. 1, through the image forming process described above, toner images for forming patch images are formed on the photoconductive drums 1*a* to 1*d*. The thus formed toner images are transferred at predetermined positions on the transfer belt 8 by the transfer rollers 4*a* to 4*d*, so that a magenta, a cyan, a yellow, and a black patch image are formed thereon.

Figure 2:
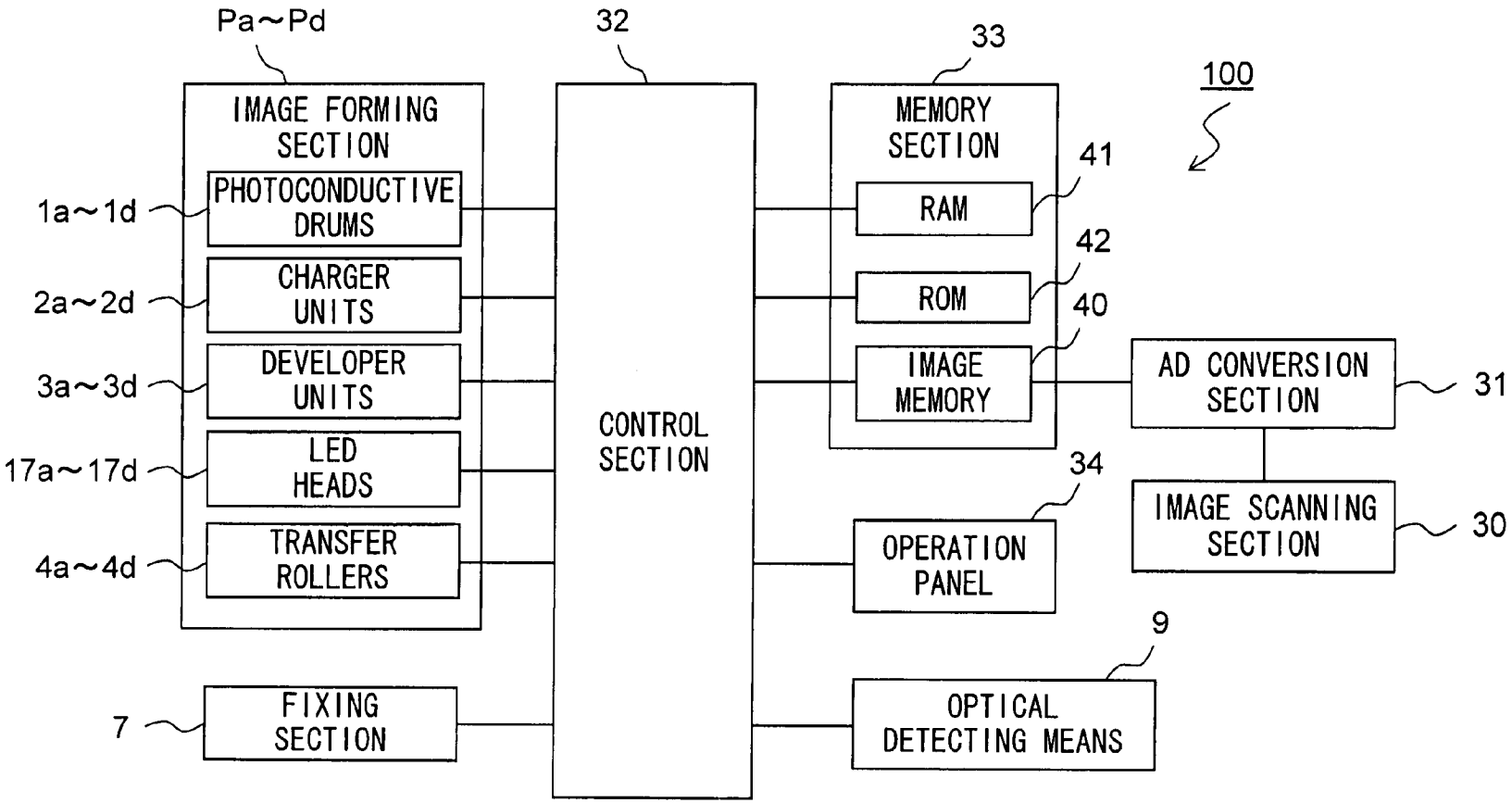
FIG. 2 is a block diagram showing the configuration of the image forming apparatus according to the present invention.

FIG. 2 is a block diagram showing the configuration of the image forming apparatus according to the present invention. Such parts as are found also in FIG. 1 are identified with common reference numerals, and no explanations thereof will be repeated. The image forming apparatus 100 includes an image scanning section 30, an AD conversion section 31, image forming sections Pa to Pd, a control section 32, a memory section 33, an operation panel 34, a fixing section 7, and optical detecting means 9.

Figure 5A:
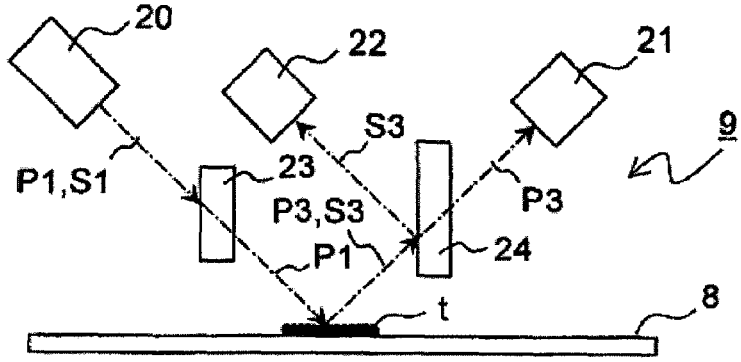
FIGS. 5A to 5C are diagrams schematically showing an example of the toner adhesion amount measurement apparatus used in a conventional image forming apparatus.
Figure 5B:
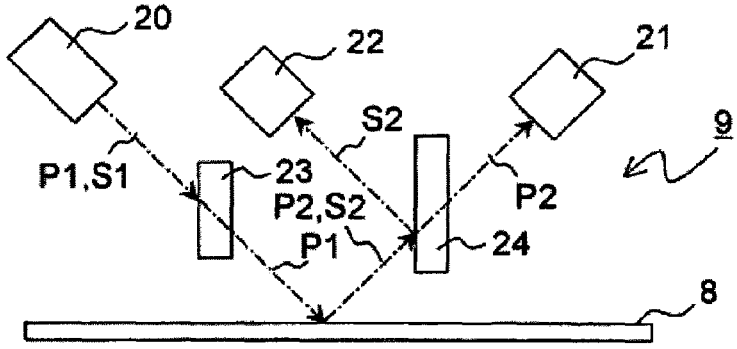
Figure 5C:
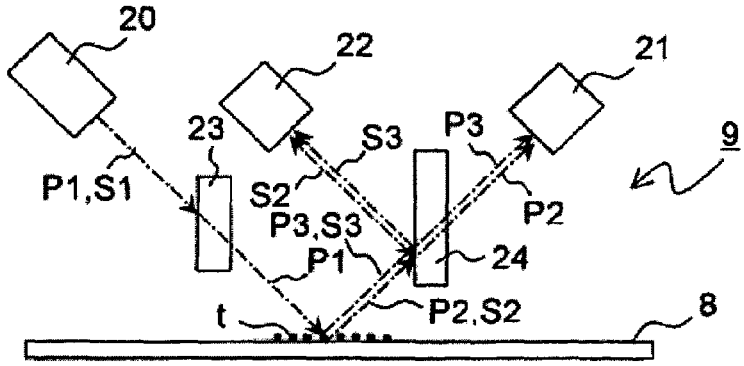

The optical detecting means 9 shines light on the patch images formed on the transfer belt 8 (see FIG. 1) in the image forming sections Pa to Pd, and detects the amounts of light reflected from the patch images. The results of detection are fed, as light reception output signals, to the control section 32, which will be described later. The optical detecting means 9 has the same arrangement as the conventional example shown in FIGS. 5A, 5B, and 5C, and therefore no explanations thereof will be repeated.

The image scanning section 30 includes the following components: a scanning optical system incorporating a scanner lamp for illuminating a document during copying and a mirror for changing the optical path of the light reflected from the document; a condenser lens for condensing and thereby focusing the light reflected from the document; and a CCD or the like for converting the thus focused image light into an electrical signal. The image signal read by the image scanning section 30 is converted into a digital signal by the AD conversion section 31, and is then fed to an image memory 40 provided in the memory section 33, which will be described later.

The memory section 33 includes an image memory 40, a RAM 41, and a ROM 42. The image memory 40 stores the image signal read by the image scanning section 30 and then converted into a digital signal by the AD conversion section 31, and feeds it to the control section 32. The RAM 41 and the ROM 42 store programs, data, and the like according to and on which the control section 32 performs processing. The RAM 41 (or the ROM 42) also has stored therein, as toner adhesion amount data, the relationship between the measurement output value of the optical detecting means 9 and the toner adhesion amount.

The operation panel 34 includes an operation section (unillustrated) provided with a plurality of operation keys and a display section (unillustrated) for displaying the settings and status of the image forming apparatus 100. Via the operation panel 34, the user makes settings on preferences for copying, and, for example in a case where the image forming apparatus 100 is equipped with facsimile capabilities, also makes other various settings, for example, for registering new facsimile transmission destinations and retrieving and rewriting registered facsimile transmission destinations.

According to the stored programs, the control section 32 controls, in a centralized fashion, the image scanning section 30, the image forming sections Pa to Pd, the fixing section 7, and the optical detecting means 9, and also converts the image signal read by the image scanning section 30 into image data by performing thereon, as necessary, magnification adjustment or halftone adjustment. According to the thus processed image data, the LED heads 17*a* to 17*d* shine laser light on the photoconductive drums 1*a* to 1*d* to form latent images thereon.

Moreover, the control section 32 is furnished with the following capabilities: when a mode for appropriately setting the density of the images of the different colors (hereinafter referred to as the calibration mode) is requested through the operation of keys on the operation panel 34, the control section 32 receives the light reception output signals detected by the optical detecting means 9, and then, based on the toner adhesion amount data stored in the memory section 33, calculates the amount of toner adhered; based on the thus calculated amount of toner adhered, the control section 32 determines the density of the patch images, then compares it with a prescribed reference density, and adjusts the charge voltage of the charger units 2*a* to 2*d*, the development bias of the developer units 3*a* to 3*d*, the amount of light emitted from the LED heads 17*a* to 17*d*, and the like to perform density correction for each color. The calibration mode may be entered automatically when the image forming apparatus 100 is started up or when image formation has been performed on a predetermined number of sheets of paper. The amount of toner adhered is calculated by the same method as in the conventional example shown in FIGS. 5A, 5B, and 5C, and therefore no explanations in this connection will be repeated.

Figure 3A:
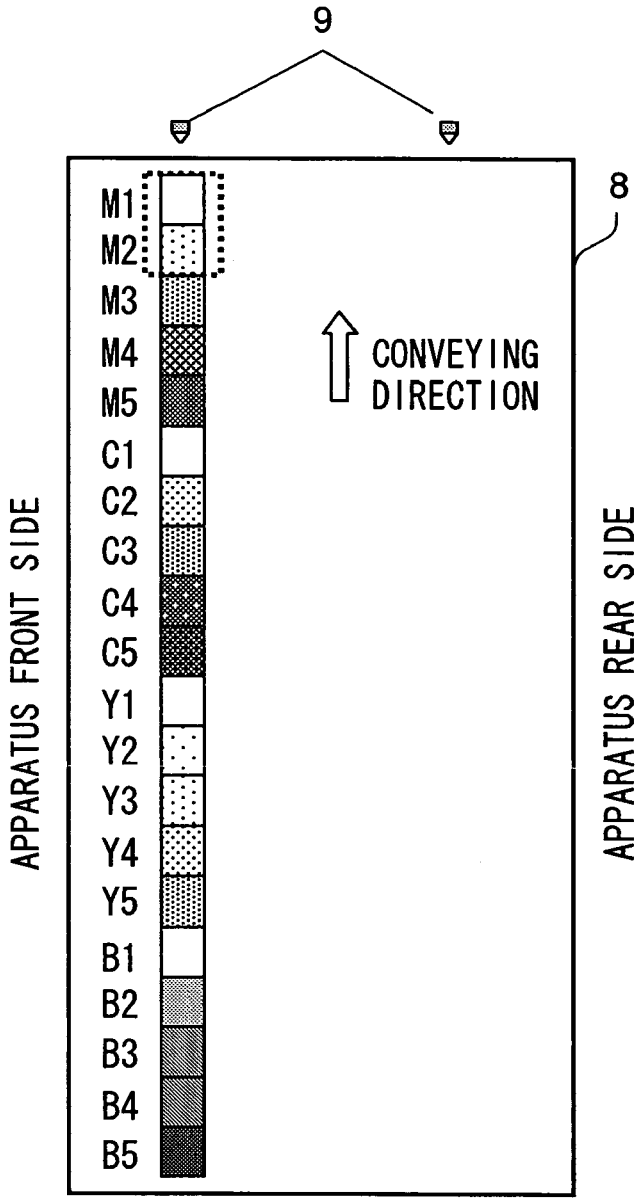
FIGS. 3A and 3B are diagrams schematically showing patch images for density correction.
Figure 3B:
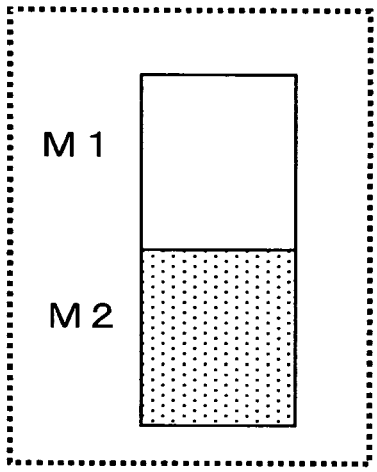

FIGS. 3A and 3B show an example of the patch images for density correction. When the user starts the calibration mode, as shown in FIG. 3A, on the transfer belt 8, along the left edge thereof with respect to the conveying direction, rectangular patch images of the different colors, namely magenta (M), cyan (C), yellow (Y), and black (B), are formed in a line. The magenta (M) patch images formed by the photoconductive drum 1*b* consist of patch image segments M1 to M5 in five different degrees of density, from solid white (M1) to the most densely colored (M5). that are formed in order of increasing numbers with respect to the conveying direction.

FIG. 3B shows, in an enlarged form, the part including the patch image segments M1 and M2 shown in FIG. 3A. As will be understood from the figure, the adjacent patch image segments M1 and M2 are each formed in a single color so that a change in density occurs at their boundary. The subsequent patch image segments M3 to M5 are formed in a similar manner, and then follow the cyan (C) patch image segments C1 to C5, the yellow (Y) patch image segments Y1 to Y5, and the black (B) patch image segments B1 to B5, which are formed in a similar arrangement to M1 to M5.

The optical detecting means 9 requires that the distance therefrom to the measurement target be precisely defined. Accordingly, as shown in FIG. 1, the optical detecting means 9 is arranged in a position facing the driven roller 10*c* where the distance from the optical detecting means 9 to the surface of the transfer belt 8 changes little, and is positioned, with respect to the width of the transfer belt 8, to face the part of the surface of the transfer belt 8 where the patch images are formed. Based on the results of detection by the optical detecting means 9, by the method described previously, the amount of toner adhered (image density) is measured for each patch image, and is then compared with the reference density prescribed for each color to perform density correction.

One feature of the present invention is that, as the transfer belt 8, one having a sufficiently low surface gloss is used. Generally, the surface gloss of the transfer belt 8 gradually lowers as the image forming apparatus is used for an extend period of time and under the influence of an additive contained in the toner. By using a transfer belt 8 with a low initial surface gloss, however, it is possible to reduce the change in the surface gloss up to the expiration of the warranted use period, and thereby to stabilize the relationship between the coverage ratio and the toner adhesion amount as calculated.

In particular, even in a case where an elastic belt is used as the transfer belt 8, there is no need to take into consideration lowering of the surface gloss resulting from deterioration of the surface condition. This makes it possible to precisely measure the amount of toner adhered, and also to prevent density loss in a central portion of a solidly colored area resulting from stress concentration.

Figure 4:
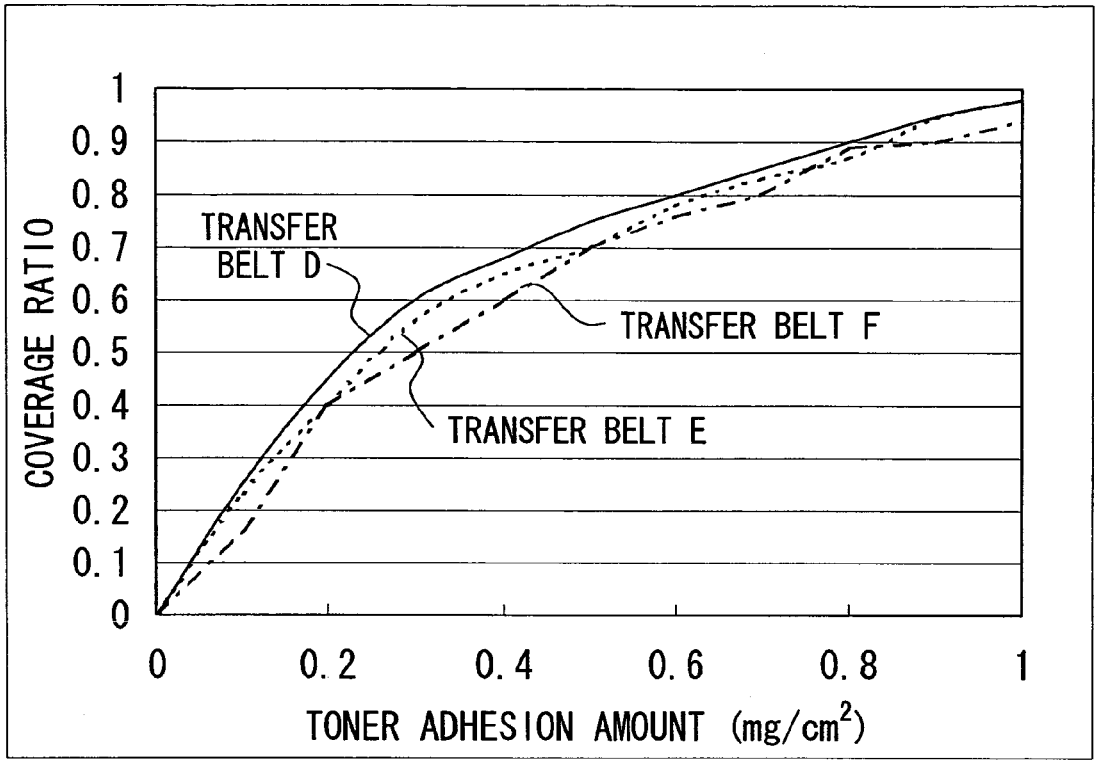
FIG. 4 is a graph showing the relationship, as observed in the image forming apparatus according to the present invention, among the change in the surface gloss of the transfer belt, the coverage ratio, and the toner adhesion amount.

FIG. 4 is a graph showing the results of measurement of the coverage ratio and the toner adhesion amount as measured with respect to three types of transfer belt D, E, and F, having different surface glosses. The transfer belt D had a grayish brown color expressed as (24, 5, 2) in L*a*b* notation, or as (68, 57, 57) in RGB notation, and the transfer belt E had a grayish brown color expressed as (26, 8, 9) in L*a*b* notation, or as (80, 59, 51) in RGB notation. The transfer belt F had a gray color expressed as (45, 2, −4) in L*a*b notation, or as (106, 105, 112) in RGB notation.

Figure 6:
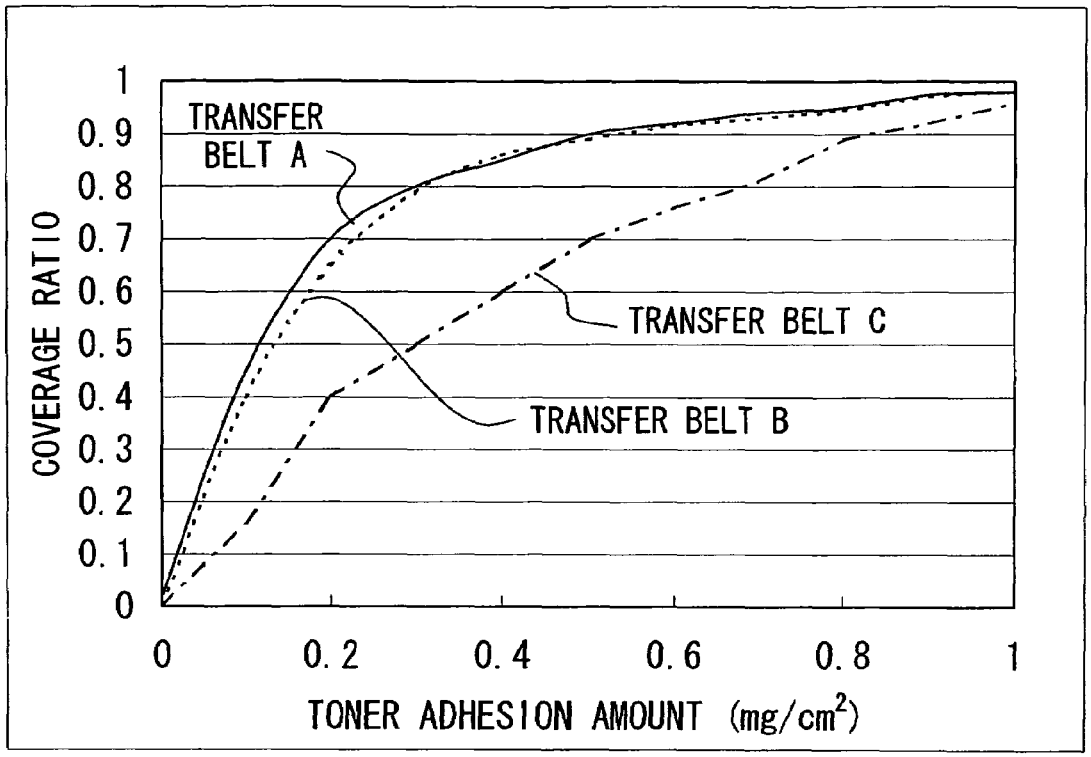
FIG. 6 is a graph showing the relationship, as observed in a conventional image forming apparatus, between the change in the surface gloss of the transfer belt, on one hand, and the coverage ratio and the toner adhesion amount, on the other.

As in the conventional example shown in FIG. 6, the surface gloss was measured on a gloss checker(the model IG-330) manufactured by HORIBA Ltd. The transfer belts D, E, and F had surface glosses of 19, 4, and 2, respectively, at a measurement angle of 60°.

In measurement of surface gloss, higher surface glosses are usually measured at smaller measurement angles, and lower surface glosses at larger measurement angles. According to Japanese Industrial Standards, measurement angles to be used for that purpose are defined as 20°, 45°, 60°, 75°, and 85°. While a measurement angle of 20° is used to measure higher surface glosses, the transfer belt used in this invention has a low surface gloss, and, in practice, a measurement angle of 60° is widely used because it permits measurement in a wide range; thus, here, a measurement angle of 60° is used. Incidentally, at a measurement angle of 20°, the transfer belts D, E, and F had surface glosses of 2, 1, and 0, respectively.

As will be clear from a comparison among the transfer belts D (indicated by a solid line in the figure), E (indicated by a dotted line in the figure), and F (indicated by a dash-and-dot line in the figure), even with transfer belts having different colors, so long as they have surface glosses of 19 or less at a measurement angle of 60°, the relationship between the coverage ratio and the toner adhesion amount remains approximately identical. Moreover, since these transfer belts have sufficiently low initial surface glosses, even when they are used for an extended period of time, they exhibit little change in their surface gloss, permitting precise measurement of the toner adhesion amount up to the expiration of the warranted normal-operation period of the belts.

Here, the difference between the output signals obtained when no toner is adhered is used as a reference value, the measurement output value is corrected based on the measurement output value divided by the reference value, and the amount of toner adhered is measured based on the corrected output value. The corrected output value, however, may be calculated in any other manner; for example, it may be calculated by further multiplying the above-mentioned corrected output value by a correction coefficient for compensating for dirt on the light-receiving device.

It should be understood that the present invention may be carried out in any manner other than specifically described above as an embodiment, and many modifications and variations are possible within the scope and spirit of the present invention. For example, the embodiment described above deals with a case where toner images are formed on a transfer belt 8 as a example of a toner carrying member and the amounts of toners adhered to the transfer belt 8 are measured. The present invention, however, is applicable not only to a construction involving a transfer belt 8 but also in a case where, in an image forming apparatus where toner images of different colors are laid one on top of another on an intermediary transfer belt and are then transferred all at once onto transfer paper, the amounts of toners adhered to the intermediary transfer belt are measured.

The above description deals with, as an example, a tandem-type color image forming apparatus provided with a plurality of image forming sections. Needless to say, the present invention is applicable also to, for example, a rotary-type color image forming apparatus in which electrostatic latent images are developed on a photoconductive drum by a plurality of developer cartridges that are so rotated as to be located one after another in a position facing the photoconductive drum, or a digital or analog monochrome image forming apparatus, or any other type of image forming apparatus such as a facsimile machine or a printer.

According to the present invention, even when the surface condition of the toner carrying member changes through continued use or under the influence of an additive contained in the toner, the surface gloss changes less up to the expiration of the warranted use period. This stabilizes the relationship between the coverage ratio and the toner adhesion amount as calculated, and thus makes it possible to precisely measure the amount of toner adhered. Thus, it is possible to achieve highly precise density correction regardless of the surface condition of the toner carrying member, and thus it is possible to realize an image forming apparatus that can form high-quality images.

Moreover, a toner carrying member having a low initial surface gloss is used, and the amount of toner adhered is calculated with the levels of the light reception output signals corrected according to the change in the surface condition of the toner carrying member. Thus, thanks to the combined effect of the method for calculating the amount of toner and the reduced change in surface gloss, it is possible to realize an image forming apparatus that permits highly precise density correction regardless of the change in the surface condition of the toner carrying member from the start of the use of the toner carrying member until the expiration of its warranted use period.

Moreover, since a transfer belt or an intermediary transfer belt is used as the toner carrying member, it is possible to precisely measure the amount of toner adhered during density correction both in an image forming apparatus where toner images of different colors are formed on transfer paper conveyed on a transfer belt and in an image forming apparatus where color images are formed by being laid one on top of another on an intermediary transfer belt and are then transferred all at once onto transfer paper.

Moreover, when an elastic belt is used as the transfer belt or the intermediary transfer belt, it is possible to precisely measure the amount of toner adhered, and also to reduce stress concentration between the belt and the photoconductive drum and thereby effectively prevent density loss in a central portion of a solidly colored area.

What is claimed is:

1. An image forming apparatus comprising:

optical detecting means for shining light on a reference image formed on a toner carrying member to measure an amount of regularly reflected light and an amount of irregularly reflected light simultaneously;

controlling means for detecting an amount of toner adhered in the reference image based on a difference between light reception output signals representing the amount of regularly reflected light and the amount of irregularly reflected light measured by the optical detecting means for a purpose of controlling image density; and a toner carrying member that has an initial surface gloss of 20 or less at a measurement angle of 60 degrees prior to its first use, wherein the image forming apparatus is so adjusted that the light reception output signals representing the amount of regularly reflected light and the amount of irregularly reflected light as obtained when a predetermined amount of toner is adhered to the toner carrying member have an equal level.

2. The image forming apparatus of claim 1, wherein the controlling means sets, as a reference value, the difference between the light reception output signals representing the amount of regularly reflected light and the amount of irregularly reflected light as measured when no toner is adhered to the toner carrying member, calculates a corrected output value by correcting, based on the reference value, the difference between the light reception output signals representing the amount of regularly reflected light and the amount of irregularly reflected light as measured when a toner image is formed on the toner carrying member, and calculates, based on the corrected output value, the amount of toner adhered to the toner carrying member.

3. The image forming apparatus of claim 1, wherein the toner carrying member is a transfer belt for conveying a recording medium.

4. The image forming apparatus of claim 1, wherein the toner carrying member is an intermediary transfer belt on which toner images to be transferred to a recording medium are laid one on top of another.

5. The image forming apparatus of claim 2, wherein the toner carrying member is a transfer belt for transferring a recording medium.

6. The image forming apparatus of claim 2, wherein the toner carrying member is an intermediary transfer belt on which toner images to be transferred to a recording medium are laid one on top of another.

7. The image forming apparatus of claim 3, wherein the transfer belt is an elastic belt.

8. The image forming apparatus of claim 4, wherein the transfer belt is an elastic belt.

9. The image forming apparatus of claim 5, wherein the transfer belt is an elastic belt.

10. The image forming apparatus of claim 6, wherein the transfer belt is an elastic belt.

* * * * *